US009854906B1

(12) United States Patent
Ke

(10) Patent No.: US 9,854,906 B1
(45) Date of Patent: Jan. 2, 2018

(54) SHELVING STRUCTURE

(71) Applicant: Chia-Nan Ke, Changhua (TW)

(72) Inventor: Chia-Nan Ke, Changhua (TW)

( * ) Notice: Subject to any disclaimer, the term of this patent is extended or adjusted under 35 U.S.C. 154(b) by 0 days.

(21) Appl. No.: 15/421,319

(22) Filed: Jan. 31, 2017

(30) Foreign Application Priority Data

Jun. 16, 2016 (TW) ..... 105209023 U

(51) Int. Cl.

| | |
|---|---|
| ***A47B 57/34*** | (2006.01) |
| ***A47B 47/00*** | (2006.01) |
| ***A47B 57/54*** | (2006.01) |
| ***A47B 96/14*** | (2006.01) |
| ***A47B 96/02*** | (2006.01) |
| ***A47B 57/26*** | (2006.01) |

(52) U.S. Cl.
CPC ..... *A47B 57/34* (2013.01); *A47B 47/0083* (2013.01); *A47B 57/265* (2013.01); *A47B 57/545* (2013.01); *A47B 96/021* (2013.01); *A47B 96/1441* (2013.01)

(58) Field of Classification Search
CPC ..... A47B 57/34; A47B 57/54; A47B 57/545; A47B 57/265; A47B 47/0083; A47B 96/021; A47B 96/1441
See application file for complete search history.

(56) References Cited

U.S. PATENT DOCUMENTS 2,588,818 A * 3/1952 Franks ..... F16B 12/50 403/217
3,065,860 A * 11/1962 Swanson ..... A47B 96/021 108/106
3,915,101 A * 10/1975 Onori ..... A47B 47/03 108/106
3,964,404 A * 6/1976 Mueller ..... A47B 57/265 108/147.14
4,132,178 A * 1/1979 Mueller ..... A47B 57/265 108/106
4,138,953 A * 2/1979 Tashman ..... A47B 57/265 108/147.13
4,257,333 A * 3/1981 Pollack ..... A47B 57/265 108/147.13

(Continued)

FOREIGN PATENT DOCUMENTS

EP 1129644 A1 * 3/2000
FR 2554182 A1 * 5/1985 ..... A47B 96/021
FR 2609145 A1 * 7/1988 ..... A47B 96/021

*Primary Examiner* — Stanton L Krycinski

(74) *Attorney, Agent, or Firm* — Che-Yang Chen; Law Offices of Scott Warmuth

(57) ABSTRACT

A shelving structure may include at least four vertical posts, at least four annular spacers, and at least a shelf board, and the posts are configured to be mounted on the shelf board through the annular spacers. The shelf board has a frame and a panel, and a convex portion is formed at an inner edge of the frame. At least eight horizontal supporting boards are formed at four upper edges and four lower edges of the frame respectively. Each two adjacent supporting boards are not connected to each other, and each of four corners of the frame is bent to form a concave groove. Moreover, four arc boards are respectively assembled with the four concave grooves, and each of the arc boards has two wings configured to be welded with the convex portion of the frame to improve the structural strength of the shelving structure.

5 Claims, 10 Drawing Sheets

(56) References Cited

U.S. PATENT DOCUMENTS

| | | | | | |
|---|---|---|---|---|---|
| 4,467,729 | A * | 8/1984 | Featherman | A47B 57/16 | 108/107 |
| 4,754,712 | A * | 7/1988 | Olson | A47B 57/265 | 108/107 |
| 4,811,670 | A * | 3/1989 | Kolvites | A47B 57/265 | 108/107 |
| 4,852,501 | A * | 8/1989 | Olson | A47B 57/265 | 108/107 |
| 5,002,247 | A * | 3/1991 | Dispenza | A47B 13/021 | 108/147.14 |
| 6,848,659 | B1 * | 2/2005 | Liu | A47B 47/024 | 108/147.13 |
| 8,016,140 | B2 * | 9/2011 | Hsieh | A47B 47/0083 | 211/187 |
| 8,733,564 | B2 * | 5/2014 | Fitzgerald | A47B 57/50 | 211/191 |
| 9,386,855 | B2 * | 7/2016 | Sabounjian | A47B 96/14 | |
| 2007/0034584 | A1 * | 2/2007 | Park | A47B 57/265 | 211/187 |
| 2009/0250572 | A1 * | 10/2009 | Cheng | A47B 47/0008 | 248/188.6 |
| 2010/0155352 | A1 * | 6/2010 | Hsieh | A47B 47/0083 | 211/134 |
| 2016/0120313 | A1 * | 5/2016 | Tang | A47B 96/021 | 211/134 |

* cited by examiner

SHELVING STRUCTURE

FIELD OF THE INVENTION

The present invention relates to a shelving structure, and more particularly to a shelving structure that can be made with a lower manufacturing cost and has a stronger structural strength.

BACKGROUND OF THE INVENTION

Referring to FIGS. 8 to 11, a conventional shelf comprises a plurality of shelf boards (40) which are parallel with each other. Each of shelf boards (40) has a board (not shown in FIGs.), and a frame (41) is formed around the board. Moreover, the shelf has at least four posts which are formed at four corners thereof and configured to connect the shelf boards (40) through a plurality of plastic connecting units. Each of the frames (41) has two horizontal folded portions (411) respectively formed at an upper edge and a lower edge thereof, and each of the folded portions (411) is formed with a preferred width. Each of the folded portions (411) has four recesses (412) respectively formed at four corners thereof, and four sleeves (42) are respectively engaged at four corners of the frame (41) through the recesses (412) at the same corner. Through ultrasonic welding, the sleeves (42) are configured to be firmly secured at the recesses (412) of the frame (41). In the assembly process, each of the four posts is configured to be inserted into and secured inside the sleeve (42) of the shelf board (40) through the plastic connecting unit, and wherein each of the plastic connecting units is configured to be abutted against the sleeve (42) and firmly secured on the post, thus completing the connection between the shelf board (40) and the posts.

However, the conventional shelf is disadvantageous because: although the sleeves (43) are respectively and firmly secured inside the recesses (412) of the frame (41) of the shelf board (40) through the ultrasonic welding, each of the sleeves (43) only contact the folded plates (411) of the frame (41) at two end edges thereof, which only has small contact areas between the recesses (412) and the single sleeve (43). When a user put an object on the shelf board (40), the shearing strength induced at positions between the recesses (412) and the sleeve (43) is configured to break the structure of the shelf board (40), which is unsafe for use. Therefore, there remains a need for a new and improved design for a shelf to overcome the problems presented above.

SUMMARY OF THE INVENTION

The present invention provides a shelving structure which comprises at least four vertical posts, at least four annular spacers, and at least a shelf board. Wherein the posts are configured to be mounted on the shelf board through the annular spacers. The shelf board has a frame and a panel, and a convex portion is formed at an inner edge of the frame. At least eight horizontal supporting boards which are respectively tilted with a preferable angle are formed at four upper edges and four lower edges of the frame respectively, and each two opposed supporting boards are parallel with each other. Moreover, each of the supporting boards has an inner edge which is bent to form a hook-like lip portion. Each two adjacent supporting boards are not connected to each other, and each of four corners of the frame is bent to form a concave groove. Moreover, four arc boards are respectively assembled with the four concave grooves, and each of the arc boards has two wings extending from two lateral sides thereof, and the wings are configured to be welded with the frame, thereby forming a connecting tube between the arc board and the concave groove to couple with and secure the annular spacer.

Comparing with conventional shelves, the present invention is advantageous because: (i) the shelf board has the four concave grooves formed at the four corners thereof, and each of the concave grooves is engaged with the arc board which is configured to reduce the manufacturing cost; (ii) each of the arc boards has the two wings which are configured to be welded with the convex portion of the frame, thus improving the structural strength and life time of the shelf; (iii) when each of the annular spacers is received in the connecting tube, the convex portion of the frame is configured to abut against the annular spacer such that the annular spacer is configured to abut against the connecting tube of the shelf board with a large contact area, thus improving the structural strength between the annular spacer and the post; and (iv) each of the supporting boards has one bend lip portion, which is configured to prevent a user from cuts by the supporting boards during installation or moving process thereby improving the safety of use.

DETAILED DESCRIPTION OF THE INVENTION

Figure 1:
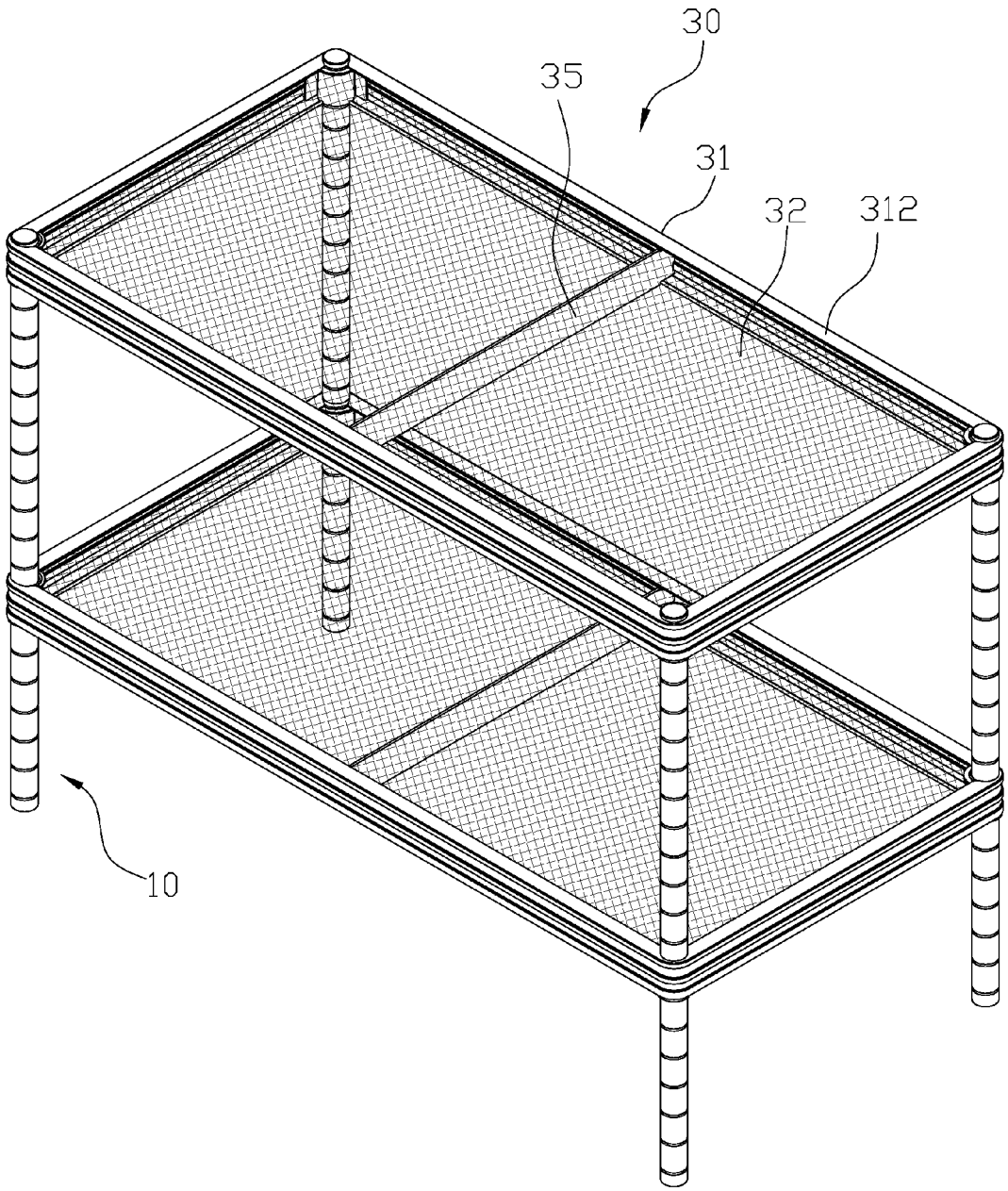
FIG. 1 is a three-dimensional assembly view of a shelving structure of the present invention.
Figure 2:
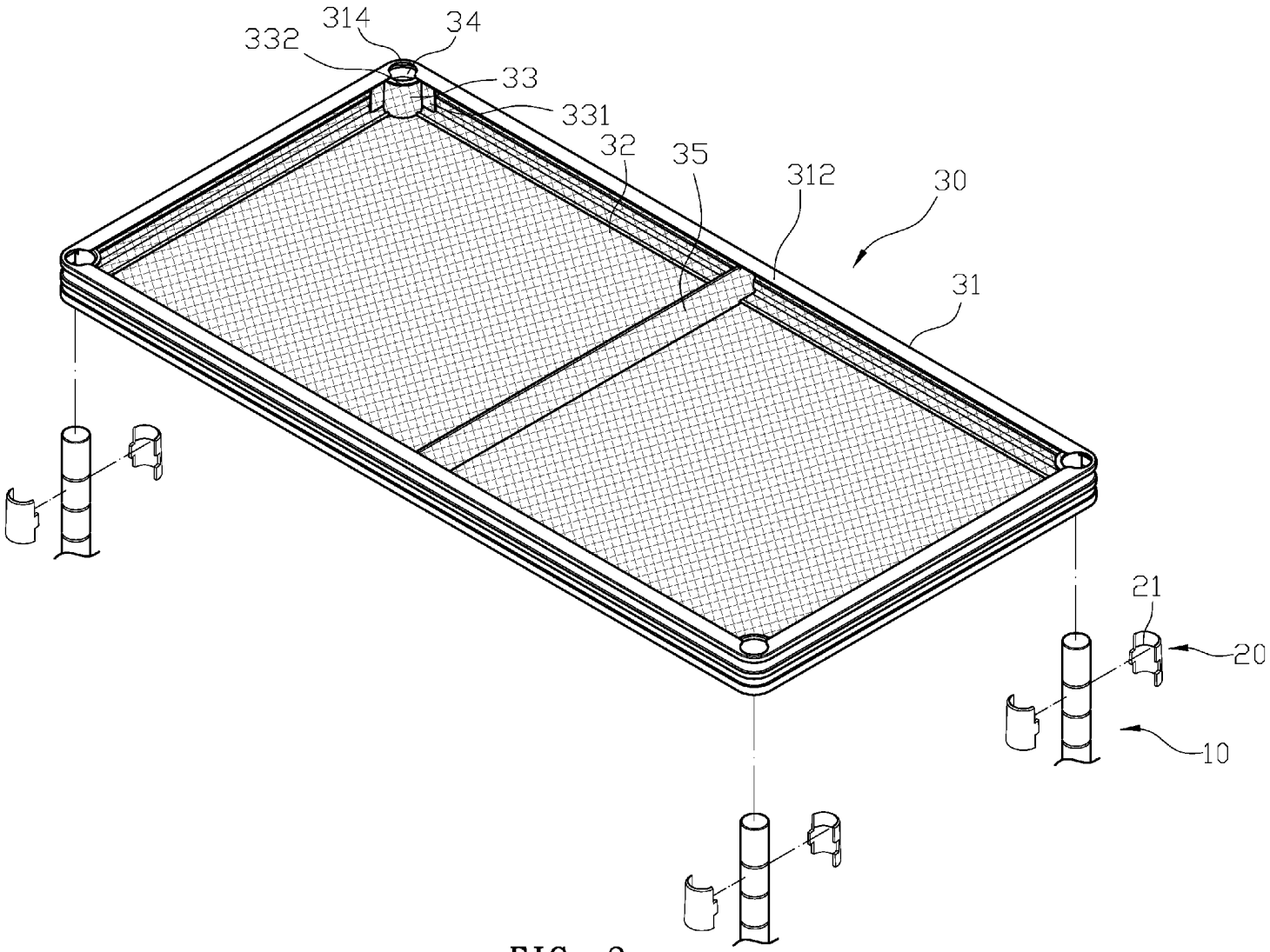
FIG. 2 is a three-dimensional exploded view of a shelf board and four vertical posts of the shelving structure in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a shelving structure which comprises at least four vertical posts (10), at least four annular spacers (20), and at least a shelf board (30). Wherein the posts (10) are configured to be mounted on the shelf board (30) through the annular spacers (20). The shelf board (30) has a frame (31) and a panel (32), and a convex portion (311) is formed at an inner edge of the frame (31). At least eight horizontal supporting boards (312) which are respectively tilted with a preferable angle are formed at four upper edges and four lower edges of the frame (31) respectively, and each two opposed supporting boards are parallel with each other. Moreover, each of the supporting boards (312) has an inner edge which is bent to form a hook-like lip portion (313). Each two adjacent supporting boards (312) are not connected to each other, and each of four corners of the frame (31) is bent to form a concave groove (314). Moreover, four arc boards (33) are respectively assembled with the four concave grooves (314), and each of the arc boards (33) has two wings (331) extending from two lateral sides thereof, and an abutting portion (332) is horizontally bent and formed at an upper end of the arc board (33). Wherein a position of the abutting portion (332) is higher than the wings (331) such that the wings (331) are configured to be welded with the frame (31) and each of the abutting portions (332) is configured to abut against the supporting boards (312), which are located at the upper edge of the frame (31), at two sides thereof, thereby forming a connecting tube (34) between the arc board (33) and the concave groove (314) to couple with and secure the annular spacer (20). In addition, the panel (32) received in the frame (31) through an outer edge thereof is secured with the supporting boards (312) at the upper edge of the frame (31). Also, at least a reinforcing bar (35) is formed inside the panel (32), and two ends of the reinforcing bar (35) are respectively secured on two parallel edges of the frame (31). Wherein each of the two ends of the reinforcing bar (35) has a recess portion (351), and the two recess portions (351) are configured to respectively engage with the convex portion (311) at the two parallel edges of the frame (31). Moreover, each of the two ends of the reinforcing bar (35) comprises two engaging notches (352) respectively formed at an upper edge and a lower edge thereof.

Figure 3:
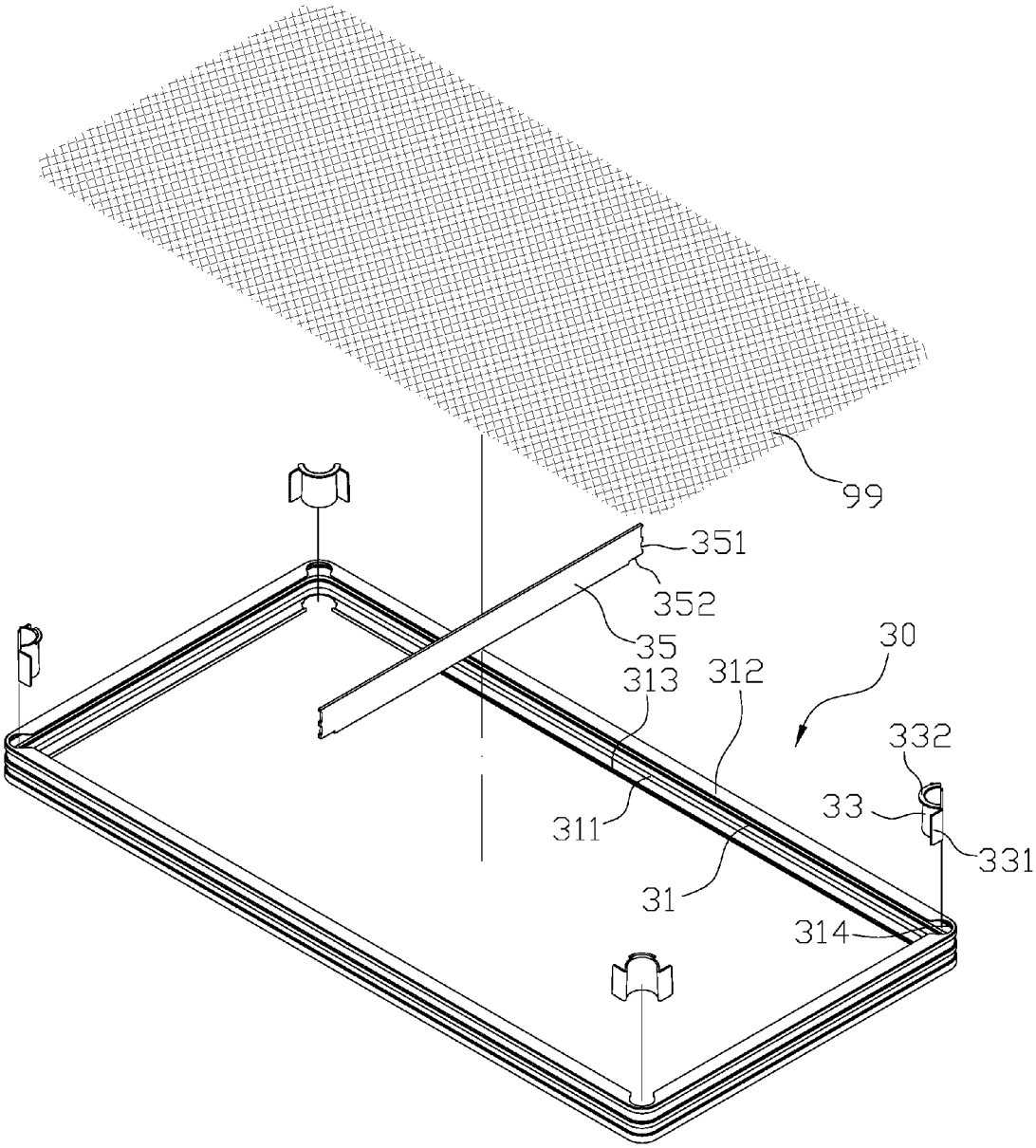
FIG. 3 is an exploded view of the shelf board of the shelving structure in the present invention.
Figure 4:
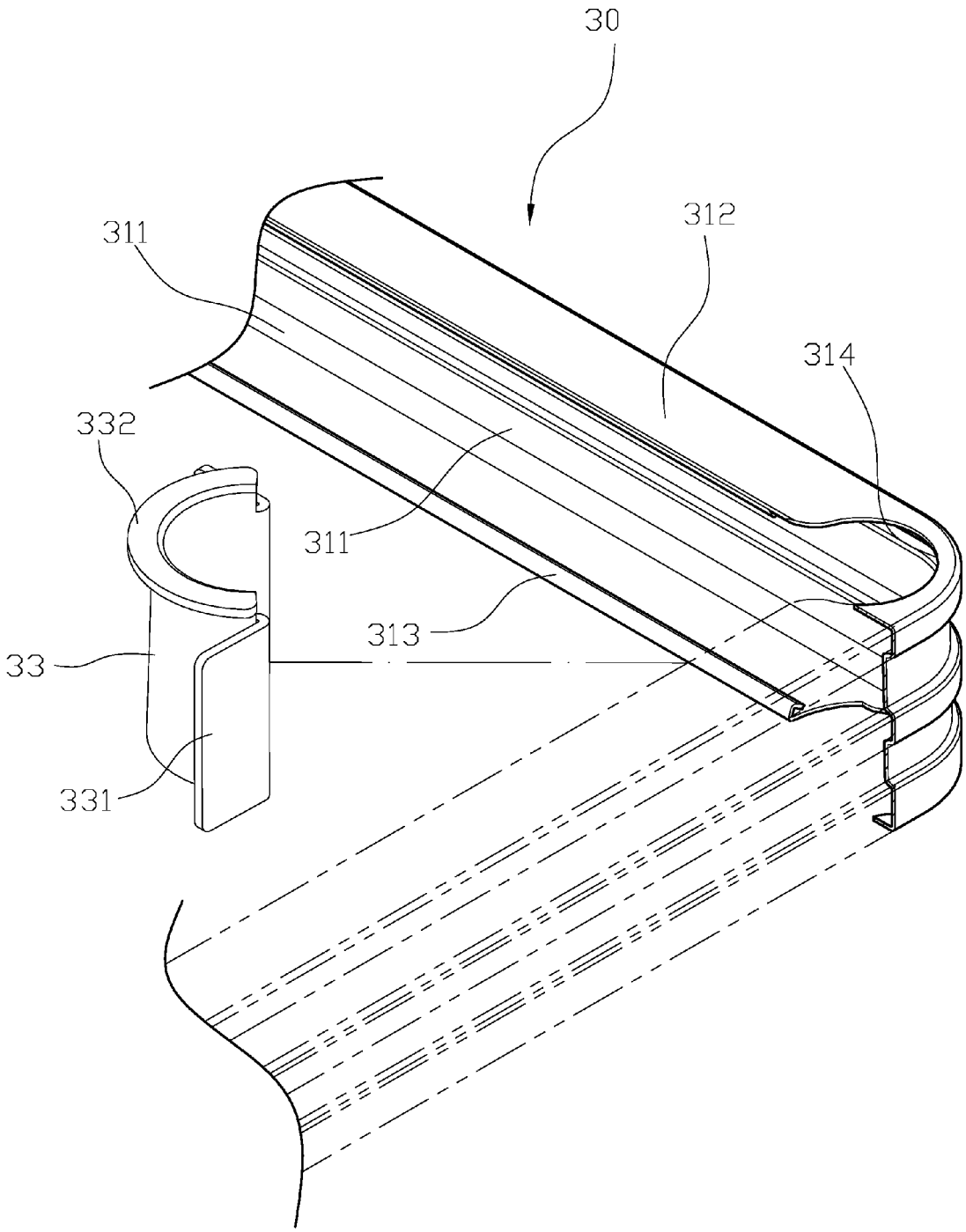
FIG. 4 is a partial enlarged exploded view of a frame and an arc board of the shelving structure in the present invention.
Figure 5:
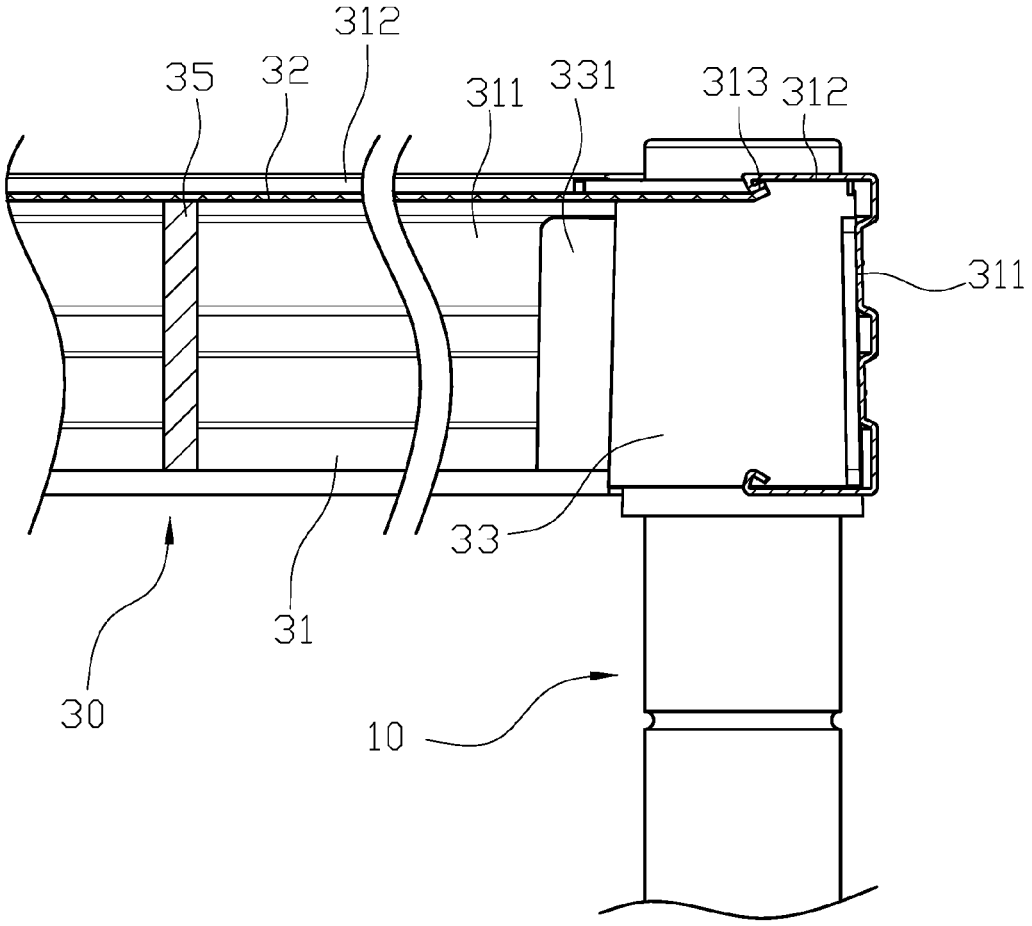
FIG. 5 is a sectional assembly view of the shelving structure in the present invention.
Figure 6:
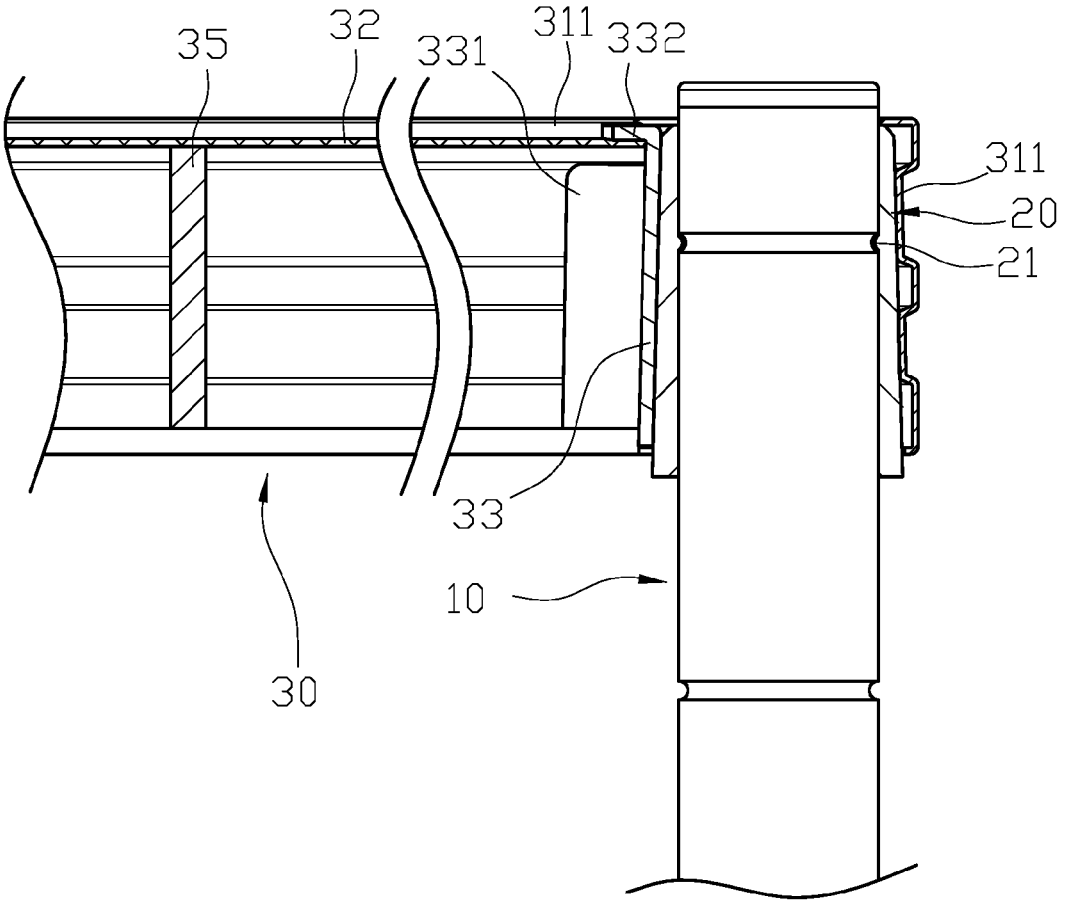
FIG. 6 is a sectional assembly view from another angle of the shelving structure in the present invention.
Figure 7:
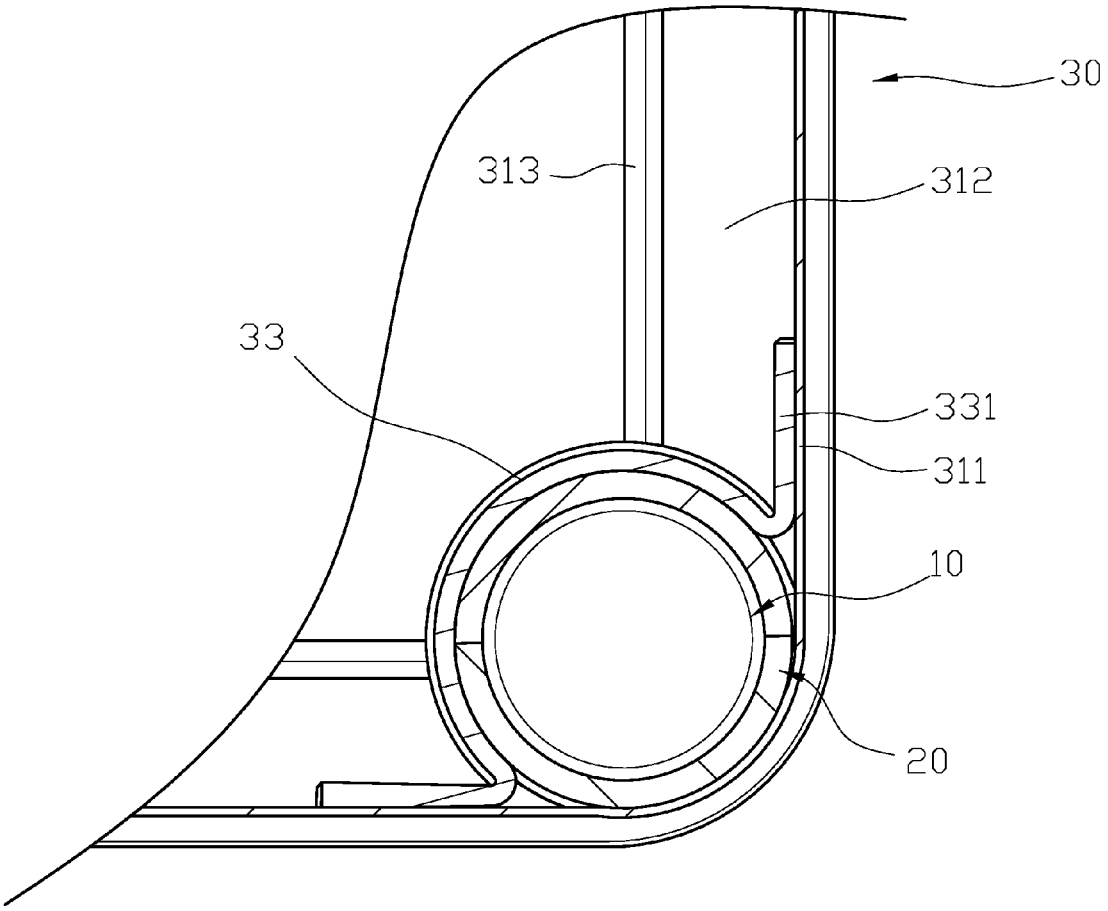
FIG. 7 is a sectional assembly view from a third angle of the shelving structure in the present invention.
Figure 8:
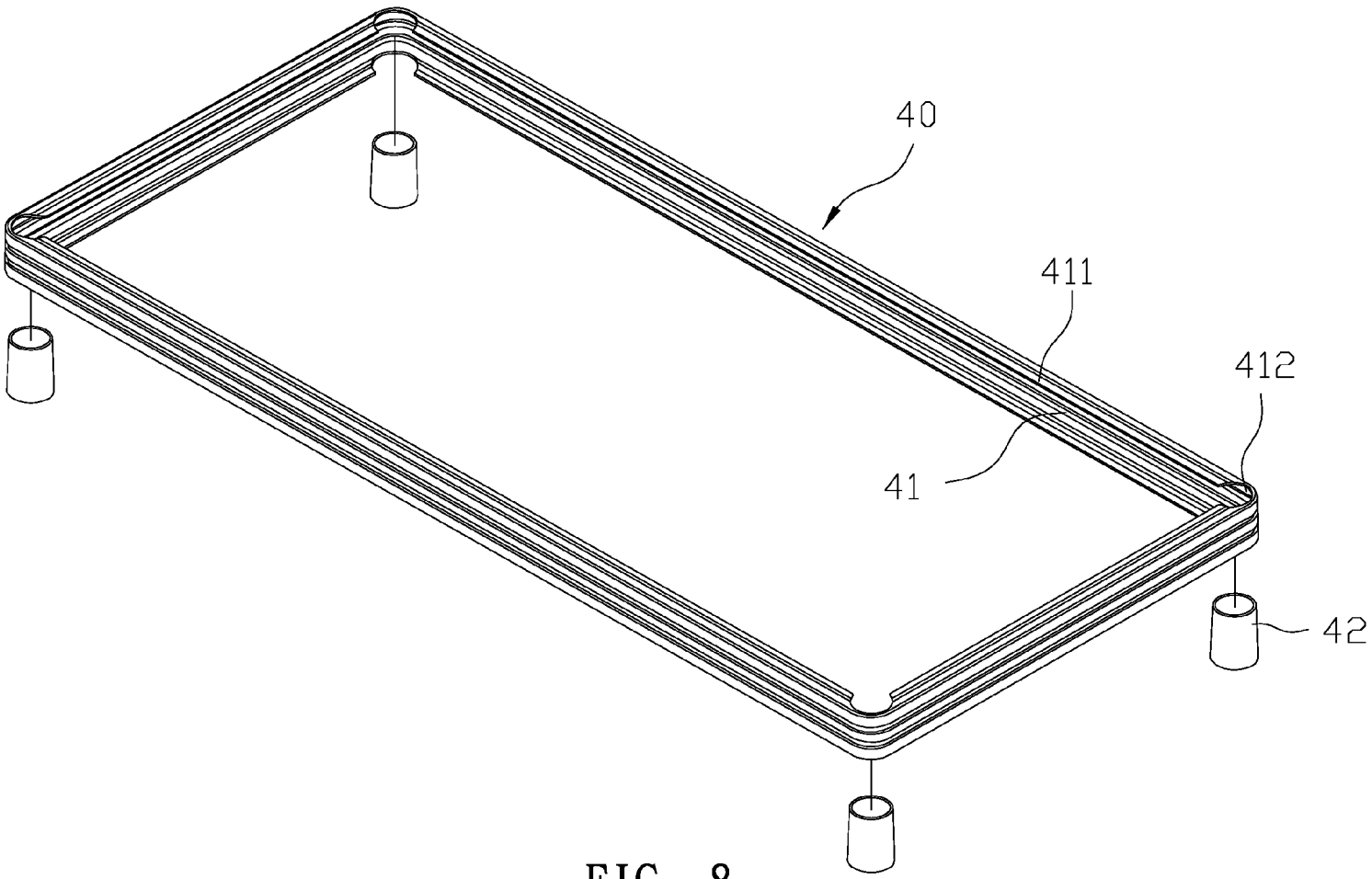
FIG. 8 PRIOR ART
FIG. 8 is a prior art.
Figure 9:
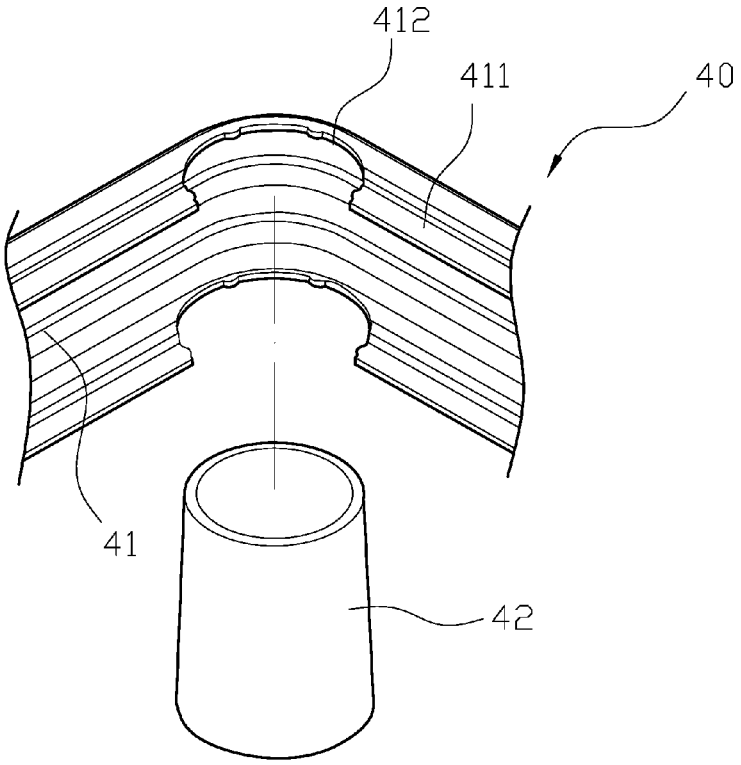
FIG. 9 PRIOR ART
FIG. 9 is a prior art.
Figure 10:
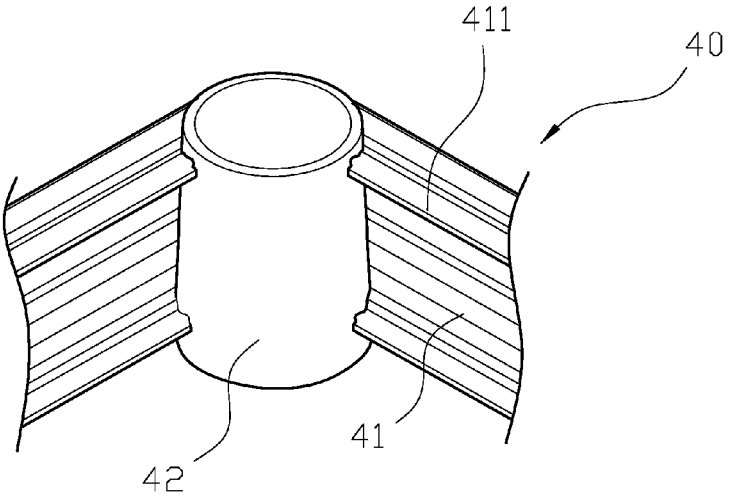
FIG. 10 PRIOR ART
FIG. 10 is a prior art.
Figure 11:
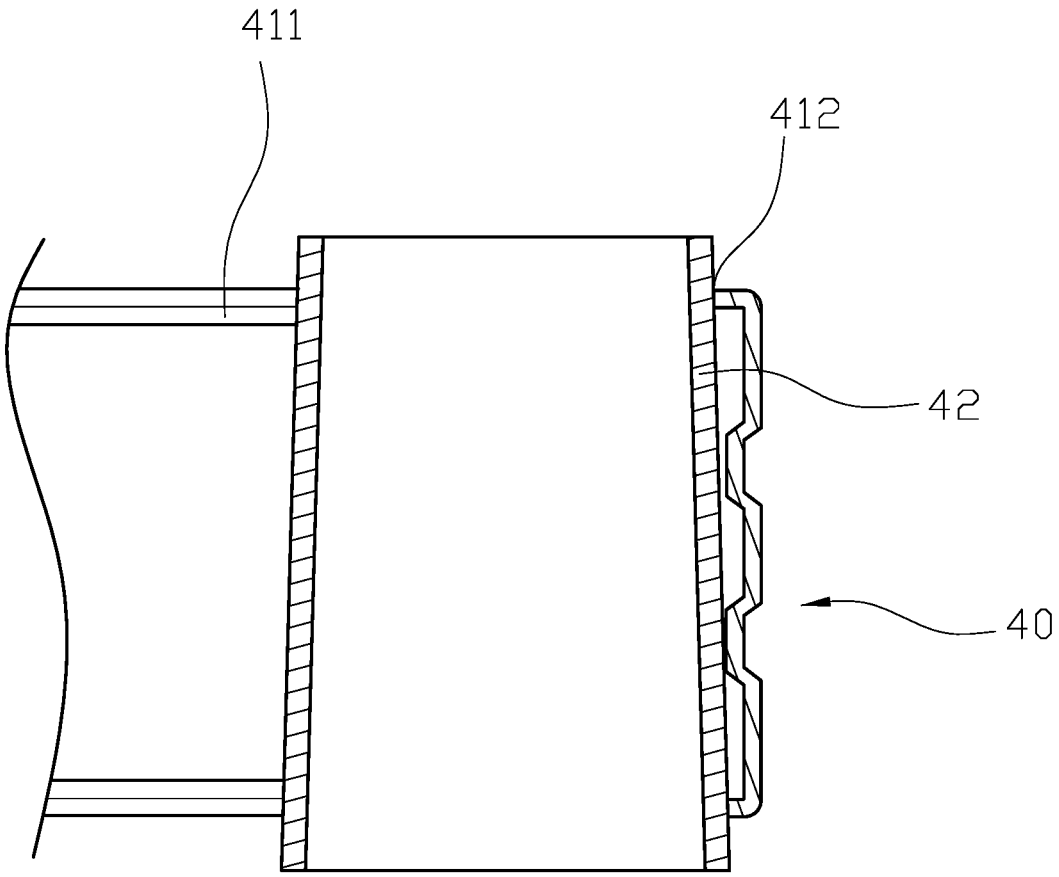
FIG. 11 PRIOR ART
FIG. 11 is a prior art.

Structurally, referring to FIGS. 3 and 4, the four arc boards (33) are respectively secured with the four concave grooves (314) located at the four corners of the frame (31) of the shelf board (30), and each of the arc boards (33) is inserted into the frame (31) through the two wings (331) thereof. Furthermore, the two wings (331) are configured to be welded on the convex portion (311) of the frame (31), and concurrently the abutting portion (332) of the arc board (33) is configured to upwardly abut against the two supporting boards (312) located at two sides of the concave groove (314), thus securing the arc board (33) on the corner of the frame (31). Additionally, each of the four connecting tubes (34) is formed between the arc board (33) and the concave groove (314). In one embodiment, the panel (32) is a general enclosed panel or a mesh panel. The panel (32) is positioned on an upper portion of the frame (31), and four edges of the panel (32) are respectively secured by the four supporting boards (312). Also, the shelf board (30) has at least one reinforcing bar (35), and the two ends thereof are respectively received in two parallel edges of the frame (31). Moreover, the two ends of the reinforcing bar (35) comprises the recess portions (351) which are configured to engage with the convex portion at the two parallel edges of the frame (31) such that the reinforcing bar (35) is configured to support a bottom of the panel (32), thereby enhancing the loading capability of the panel (32).

In actual application, referring to FIGS. 1, 2, and 5 to 7, the four posts (10) are mounted on the shelf board (30) at four corners thereof, and each of the four annular spacers (20) disposed on an upper portion of the post (10) is configured to receive in the connecting tube (34) of the shelf board (30). Wherein each of the four annular spaces (20) is configured to concurrently abut against the arc board (33) and the convex portion (311) of the frame (31) located at two sides of the arc board (33), thus firmly securing the annular spacer (20) with the connecting tube (34). In addition, the posts (10) are formed in bamboo shape, and each of the annular spacers (20) has at least a horizontal engaging rib (21) protruding from an inner surface thereof. Thus, each of the annular spacers (20) is configured to be abutted by the connecting tube (34) to firmly dispose on the post (10).

Comparing with conventional shelves, the present invention is advantageous because: (i) the shelf board (30) has the four concave grooves (314) formed at the four corners thereof, and each of the concave grooves (314) is engaged with the arc board (33) which is configured to reduce the manufacturing cost; (ii) each of the arc boards (33) has the two wings (331) which are configured to be welded with the convex portion (311) of the frame (31), thus improving the structural strength and life time of the shelf; (iii) when each of the annular spacers (20) is received in the connecting tube (35), the convex portion (311) of the frame (31) is configured to abut against the annular spacer (20) such that the annular spacer (20) is configured to abut against the connecting tube (34) of the shelf board (30) with a large contact area, thus improving the structural strength between the annular spacer (20) and the post (10); and (iv) each of the supporting boards (312) has one bend lip portion (313), which is configured to prevent a user from cuts by the supporting boards (312) during installation or moving process thereby improving the safety of use.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A shelving structure comprising at least four vertical posts, at least four annular spacers, and at least a shelf board:

wherein the posts are configured to be mounted on the shelf board through the annular spacers; the shelf board has a frame and a panel, and a convex portion is formed at an inner edge of the frame; at least eight horizontal supporting boards which are respectively tilted with a preferable angle are formed at four upper edges and four lower edges of the frame respectively, and each of the two supporting boards opposed with each other are parallel, and each of the supporting boards has an inner edge which is bent to form a hook lip portion; each of the two supporting boards adjacent to each other are not connected, and each of four corners of the frame is bent to form a concave groove; four arc boards are respectively coupled with the four concave grooves, and each of the arc boards has two wings extending from two lateral sides thereof, and the wings are configured to be secured with the frame through welding thereby forming a connecting tube between the arc board and the concave groove, and when each of the annular spacers is received in the connecting tube, the convex portion of the frame is configured to abut against the annular spacer such that the annular spacer is configured to abut against the connecting tube of the shelf board with a large contact to improve the structural strength between the annular spacer and the post.

2. The shelving structure of claim 1, wherein an abutting portion is horizontally bent and formed at an upper end of the arc board, and a position of the abutting portion is located higher than the wings.

3. The shelving structure of claim 1, wherein the panel is received in the frame through an outer edge thereof and welded with the supporting boards at the upper edges of the frame.

4. The shelving structure of claim 1, wherein at least a reinforcing bar is formed inside the panel, and two ends of the reinforcing bar are respectively secured on two parallel edges of the frame.

5. The shelving structure of claim 4, wherein each of the two ends of the reinforcing bar has a recess portion, and each of the two recess portions are configured to respectively engage with the convex portion at the two parallel edges of the frame; and wherein each of the two ends of the reinforcing bar comprises two engaging notches respectively formed at an upper edge and a lower edge thereof.

* * * * *